United States Patent [19]

Barakitis et al.

[11] Patent Number: 4,489,255

[45] **Date of Patent: * Dec. 18, 1984**

[54] DISCHARGE LAMP STARTER AND STARTING AND OPERATING CIRCUITRY

[75] Inventors: Nikolaos Barakitis, Haverhill; Sheppard Cohen, Danvers, both of Mass.

[73] Assignee: GTE Products Corporation, Stamford, Conn.

[ * ] Notice: The portion of the term of this patent subsequent to Dec. 6, 2000 has been disclaimed.

[21] Appl. No.: 398,722

[22] Filed: Jul. 19, 1982

[51] Int. Cl.[3] ..... H01J 7/44

[52] U.S. Cl. ..... 315/73; 315/362

[58] Field of Search ..... 315/47, 56, 73, 290, 315/362, DIG. 5; 337/16, 27

[56] References Cited

U.S. PATENT DOCUMENTS

| | | | |
|---|---|---|---|
| 3,965,387 | 6/1976 | Stuart et al. | 315/47 |
| 4,001,634 | 1/1977 | Corbley et al. | 315/73 |
| 4,355,265 | 10/1982 | Cohen et al. | 315/290 |

*Primary Examiner*—David K. Moore

*Attorney, Agent, or Firm*—Thomas H. Buffton

[57] ABSTRACT

Apparatus for starting and operating a discharge lamp includes a starter device having a normally-closed (N/C) switch including a pair of contacts each connected to a bimetal with the bimetals having opposite flexure deviations. Circuitry is provided for coupling one bimetal to a ballast and also to a discharge lamp whereby short-circuit current flows through both bimetals to open the switch and initiate conductivity of a discharge lamp and through one bimetal to maintain the switch operational and continue lamp conductivity.

14 Claims, 4 Drawing Figures

DISCHARGE LAMP STARTER AND STARTING AND OPERATING CIRCUITRY

TECHNICAL FIELD

This invention relates to starter apparatus and circuitry for starting and operating discharge lamps and more particularly to discharge lamp starting and operating circuitry employing a starter device having at least two bimetals therein.

BACKGROUND ART

U.S. Pat. No. 4,329,621, issued May 11, 1982 and assigned to the Assignee of the present application, provides a starter device for discharge lamps. Therein, first and second bimetal strips are connected to one another at one end forming a first switch contact. The opposite end of a first bimetal is connected to a source voltage terminal by way of a ballast and the opposite end of a second bimetal is connected to a discharge lamp. Also, a tungsten rod within the envelope forms a second contact immediately adjacent the first contact, and the tungsten rod and second bimetal are connected to opposite ends of a discharge lamp.

In operation, short-circuit current from a ballast passes through the first bimetal strip in an amount and for a time sufficient to cause flexure of the bimetal and separation of the normally-closed (N/C) first and second switch contacts. Thereupon, a pulse potential available from the ballast is applied by way of the bimetals to the discharge lamp in an amount usually sufficient to effect conduction thereof. Also, lamp current flowing through the bimetals is of an amount sufficient to maintain the first and second contacts in a separated positional location. Moreover, should the discharge lamp fail to ignite initially, the bimetals will cool and the contacts will close to again cause short-circuit current flow through the bimetals and a repeat of the above-described operation.

Additionally, the above-mentioned starting device is normally employed in a discharge lamp starting and operating circuit wherein a ballast couples one of the bimetals to a voltage source terminal with the tungsten rod coupled to the other one of a pair of voltage source terminals. The discharge device is coupled to the other bimetal and to the tungsten rod or rigid conductive member.

Although the above-described starter apparatus and starting and operating circuitry does have numerous advantages over prior known structures and circuitry, it has been found that there are applications wherein a problem still exists. For example, it has been found that there are applications wherein the first and second switch contacts tend to stick to one another and fail to open in response to the flexure of a bimetal strip. Also, it has been found that switches having one rigid contact member tend to have a relatively short life span as compared with a flexible member. Moreover, the switches with a rigid contact appear to be much more sensitive to shock as compared with flexible members.

OBJECTS AND SUMMARY OF THE INVENTION

An object of the present invention is to provide enhanced starting apparatus for discharge lamps. Another object of the invention is to improve the starting and operation of a discharge lamp. Still another object of the invention is to improve the starting and operating circuitry of discharge lamps. A further object of the invention is to provide improved starting apparatus for discharge lamps wherein the flexure of multiple bimetals is utilized in the starting and operating apparatus and circuitry.

These and other objects, advantages and capabilities are achieved in one aspect of the invention by a starter device having an envelope with three leads passing therethrough and including a normally-closed (N/C) switch means having at least two bimetals each affixed to a contact of the switch means and having a direction of flexure opposite to one another.

In another aspect of the invention, a starting and operating circuit for a discharge lamp includes a pair of terminals formed for connection to an AC potential source, a ballast means coupled to one of the pair of terminals, a starter device having a first bimetal connected to the ballast means and a second bimetal connected to the other terminal and means for coupling a discharge lamp to a conductor and to the second bimetal of the starter device.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
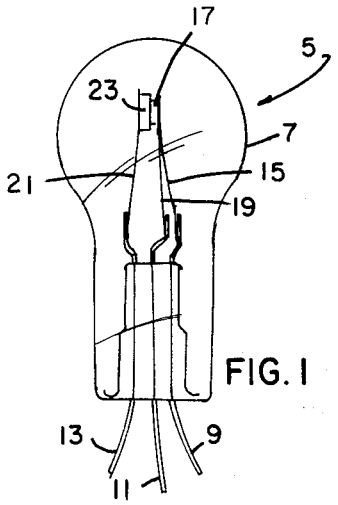
FIG. 1 is an elevational view of a glow starter device in accordance with the invention.

Referring to FIG. 1 of the drawings, a starter device 5 includes a hermetically sealed envelope 7 having three electrically conductive leads 9, 11, and 13 sealed therein and passing therethrough. Disposed within the envelope 7 is a normally-closed (N/C) switch member having a first bimetal 15 with one end thereof connected to a first electrically conductive lead 9 and the opposite end affixed to a first contact 17. A second bimetal 19 has one end connected to a second electrically conductive lead 11 and the opposite end affixed to the first contact 17 and the first bimetal 5. Also, a third bimetal 21 has one end connected to a third electrically conductive lead 13 and the other end affixed to a second contact 23.

Figure 2:
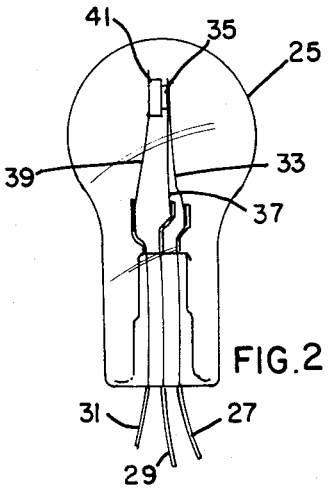
FIG. 2 is an alternate embodiment of the glow starter device of FIG. 1.

An alternate arrangement, illustrated in FIG. 2, includes a hermetically sealed envelope 25 having three electrically conductive leads 27, 29 and 31 sealed therein and passing therethrough. An electrical conductor 33 has one end affixed to the first lead 27 and the opposite end affixed to a first contact member 35. A first bimetal 37 has one end attached to the second lead 29 and the opposite end attached to the first contact member 35. A second bimetal 39 has a first end connected to the third electrically conductive lead 31 and a second end connected to a second contact member 41

Also, the hermetically sealed envelopes, 7 of FIGS. 1 and 25 of FIG. 2, may have a gas fill therein at an elevated pressure. For example, argon gas at a pressure of about 2 torr would be appropriate for a starter device 5 suitable where voltage limiting of itself is desired. Alternatively, the hermetically sealed envelope, 7 of FIGS. 1 or 25 of FIG. 2, may be in the form of an evacuated envelope suitable for use in starting an operating gaseous discharge lamp.

Figure 3:
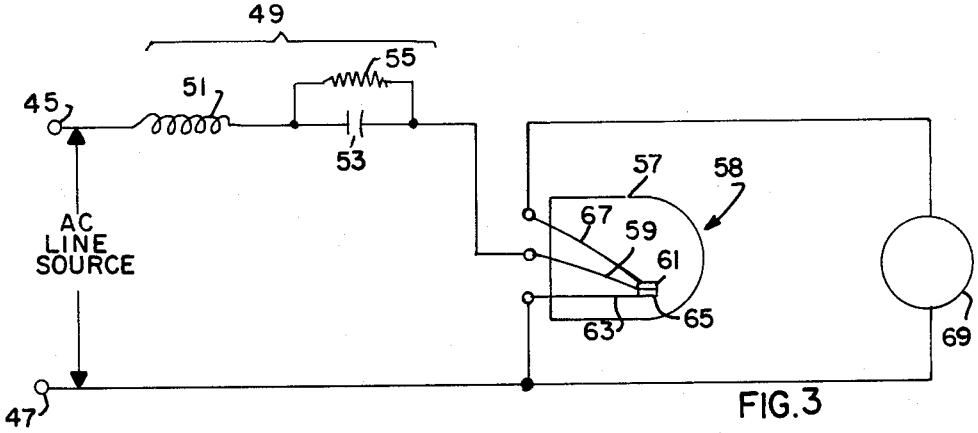
FIG. 3 is a starting and operating circuit for a discharge lamp employing an embodiment of the starter device.

Additionally, one form of starting and operating circuit for use with a discharge lamp and the starter device of FIGS. 1 and 2 is set forth in FIG. 3. Therein, a starting and operating circuit 43 includes first and second input terminals 45 and 47 formed for connection to a service voltage source such as a 110-volt AC service voltage, for example. Coupled to the first input terminal 45 is a ballast circuit 49 which includes a series-connected inductor 51 and capacitor 53 with a resistor 55 shunting the capacitor 53.

A starter device 58 has a gas-filled envelope 57 and a first bimetal 59 coupled to the ballast 49 and to a first contact member 61. A second bimetal 63 is connected to the second input terminal 47 and to a second contact member 65. Also, a third bimetal 67 has one end thereof connected to the first contact member 61 and the opposite end connected to one side of a discharge device 69. The other side of the discharge device 69 is connected to the second bimetal 63.

Figure 4:
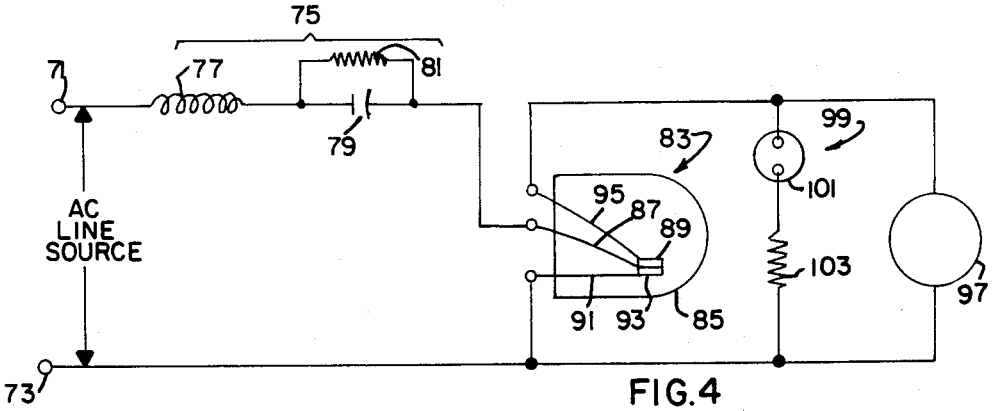
FIG. 4 is an alternate starting and operating circuit for a discharge lamp employing an alternate embodiment of the starter device of FIG. 1.

In an alternate arrangement illustrated in FIG. 4, a starting and operating circuit for a high voltage discharge lamp includes a pair of input terminals 71 and 73 formed for attachment to a potential source. A ballast 75 having an inductor 77 in series connection with a capacitor 79 shunted by a resistor 81 is connected to one 71 of the pair of input terminals. Coupled to the ballast 75 is a starter 83 having an evacuated hermetically sealed envelope 85. Disposed within the envelope 85 is a first bimetal 87 having one end coupled to the ballast 75 and the other end connected to a first contact 89 of a normally-closed (N/C) switch. A second bimetal 91 has one end connected to the other one 73 of the pair of input terminals and the other end connected to a second contact 93 adjacent the first contact.

Also, an electrical conductor 95 has one end coupled to one side of a discharge lamp 97 and the opposite end connected to the first contact 89 of the N/C switch. The other side of the discharge lamp 97 is connected to the one end of the second bimetal 91. Also, a spark gap means 99 including a series-connected spark gap 101 and current limiting resistor 103 is shunted across the discharge lamp 97. Moreover, the spark gap means 99 is selected to have an arc over voltage which is greater than the breakdown voltage of the discharge lamp 97 but less than the breakdown voltage which would be expected to cause transient voltages sufficient to destroy components of the system. The current limiting resistor 103 is of a value selected to insure long life of the adjacent component.

More specifically, one form of starting and operating circuitry includes a starter 83 having an evacuated envelope of soda lime glass and including a first bimetal 87 of a Chase #6650 material having a thickness of about 0.004 inch, a width of about 0.040 inch and a length of about ½ inch. A second bimetal 91 is of a material provided by Chase and designated #3900 with a thickness of about 0.004 inch, a width of about 0.120 inch and a length of about ⅝ inch. Affixed to the first and second bimetals 87 and 91 are first and second contacts of a material such as silver plated copper steel with a tensional force therebetween of about 4.0 gms. Also, the starter 83 is designed to handle a current of about 1.0 amperes with a low wattage high intensity discharge lamp rated at 40 watts and 50 volts. Additionally, the inductor 77 of the ballast means 75 is preferably a 320 millihenry choke wound on an iron core with an inductive reactance of about 120 ohms. Moreover, the capacitor 79, which has been found necessary in order to provide reliable lamp ignition, is of a value of about 11.0 microfarads and 240 volts.

As to operation, the starter 57 of FIG. 3 normally is in a normally-closed (N/C) condition and upon initial application of an AC potential to the input terminals 45 and 47, short-circuit current is drawn by way of the ballast means 49 and the first and second bimetals 59 and 63 of the starter 58. The resultant $I^2R$ power in the first and second bimetals 59 and 63 is sufficient to cause flexure thereof in opposing directions and separation of the contacts 61 and 65. Thus, this opposing flexure feature of the first and second bimetals 59 and 63 greatly enhances the separation capabilities of the contacts 61 and 65.

Thereupon, short-circuit current flow is interrupted, and a high voltage pulse derived from the inductor 51 of the ballast circuit means 49 is applied to the discharge lamp 69 by way of the first bimetal 59 and an electrical conductor 67. Ordinarily, this transient pulse potential is sufficient to initiate discharge of the lamp 69. However, should conductivity of the discharge lamp 69 not be initiated, no current is drawn through the bimetal 59 and cooling thereof is effected whereupon the contacts 61 and 65 close causing short-circuit current to again flow through the bimetals 59 and 63. Thus, heat generated by the $I^2R$ power causes the first and second bimetals 59 and 63 to flex in opposite directions and open the contacts 61 and 65 and initiate conductivity of the discharge lamp 69 with a transient pulse. Also, current flow through the first bimetal 59 is sufficient to maintain flexure thereof once conductivity of the discharge lamp 69 has been effected.

In an alternative embodiment of FIG. 4, it has been found that a configuration which includes an evacuated envelope 85 tends to be susceptible to excessive switching transient voltages should conductivity of the discharge lamp 97 not be initiated. Thus, the spark gap 101 and current limiting resistor 103 insure an arc-over voltage which is less than the value which would damage circuitry components but greater than the breakdown voltage of the discharge lamp 97.

While there has been shown and described what is at present considered the preferred embodiment of the invention, it will be obvious to those skilled in the art that various changes and modifications may be made therein without departing from the invention as defined by the appended claims.

What is claimed is:

1. A starter device comprising:

a hermetically sealed envelope with three electrically conductive leads extending outwardly therefrom;

an electrical conductor and a first bimetal mounted on a first and a second one of said electrically conductive leads within said envelope, said first bimetal and electrical conductor joined at an end opposite from the mounted end to form a first contact member; and a second bimetal mounted on a third one of said electrically conductive leads within said envelope and having an end opposite from the mounted end forming a second contact member of a normally-closed (N/C) switch, said first and second bimetals configured to have a flexure in diametrically opposite directions upon application of energy to said conductive leads whereby said first and second contact members forming a normally-closed switch in the absence of energization of said leads form an open switch upon energization of said leads.

2. The starter device of claim 1 wherein said envelope includes a gas therein.

3. The starter device of claim 1 wherein said envelope is an evacuated envelope.

4. The starter device of claim 1 wherein said electrical conductor is in the form of a third bimetal mounted on one of said first and second electrical conductors and connected at one end to said first bimetal.

5. The starter of claim 1 wherein said first and second bimetals are in the form of flexible strips with first and second contact members connected to said first and second bimetals respectively to form a switch member.

6. The starter of claim 2 wherein said gas within said envelope is at a subatmospheric pressure.

7. The tube of claim 2 wherein said gas is in the form of argon.

8. The tube of claim 1 wherein said first bimetal is of a thickness of about 0.004 inch, a width of about 0.040 inch and a length of about 0.5 inch.

9. The tube of claim 1 wherein said second bimetal is of a thickness of about 0.004 inch, a width of about 0.120 inch and a lengh of about $\frac{5}{8}$ inch.

10. A starter device comprising:

a hermetically sealed envelope having three electrically conductive leads passing therethrough, and first, second and third bimetal strips each having one end fastened to one of said three electrically conductive leads within said envelope, said first and third bimetal strips connected to one another at one end to form a first contact thereat and a second bimetal forming a second contact at the end thereof with said first and second contacts forming a normally-closed (N/C) switch in the absence of energization of said leads and an open switch upon energization of said leads.

11. The starter of claim 10 wherein said first and third bimetals have a flexure in a direction opposite to the direction of flexure of said second bimetal whereby a greatly increased separating force is exerted on said first and second contacts forming said switch.

12. The starter of claim 10 wherein said hermetically sealed envelope has a gas fill therein.

13. The starter of claim 10 wherein said hermetically sealed envelope is an evacuated envelope.

14. The starter of claim 12 wherein said gas fill is argon at a subatmospheric pressure.

* * * * *